US008665050B2

(12) United States Patent
Lai et al.

(10) Patent No.: US 8,665,050 B2
(45) Date of Patent: Mar. 4, 2014

(54) TRANSFORMER

(75) Inventors: Shin-Tzung Lai, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 30 days.

(21) Appl. No.: 13/436,999

(22) Filed: Apr. 2, 2012

(65) Prior Publication Data

US 2012/0286918 A1 Nov. 15, 2012

(30) Foreign Application Priority Data

May 11, 2011 (TW) ..... 100116423 A

(51) Int. Cl.

| | |
|---|---|
| ***H01F 27/30*** | (2006.01) |
| ***H01F 21/06*** | (2006.01) |
| ***H01F 17/06*** | (2006.01) |
| ***H01F 27/24*** | (2006.01) |

(52) U.S. Cl.

USPC ..... 336/198; 336/136; 336/178; 336/196; 336/208; 336/212

(58) Field of Classification Search

USPC ..... 336/136, 178, 196, 198, 208, 212

See application file for complete search history.

(56) References Cited

U.S. PATENT DOCUMENTS

| | | | | |
|---|---|---|---|---|
| 4,334,206 | A * | 6/1982 | Nakamura | 336/96 |
| 4,843,362 | A * | 6/1989 | Heritier-Best | 336/61 |
| 6,593,836 | B1 * | 7/2003 | LaFleur et al. | 336/61 |
| 7,116,205 | B2 * | 10/2006 | Hsueh et al. | 336/212 |
| 2010/0134044 | A1 * | 6/2010 | Sin | 315/294 |

* cited by examiner

*Primary Examiner* — Tsz Chan

(74) *Attorney, Agent, or Firm* — CKC & Partners Co., Ltd.

(57) ABSTRACT

A transformer includes a bobbin, an iron core assembly, and a first sleeve. The bobbin includes a main body and a channel passing through the main body. The iron core assembly includes a first iron core and a second iron core. The first end of the first iron core and the second end of the second iron core are disposed near the periphery of the bobbin. The first sleeve is disposed at a first gap between the first end and the second end, so as to make the first end and the second end to be accommodated within the first sleeve. And, the first end is aligned opposite to the second end.

7 Claims, 5 Drawing Sheets

TRANSFORMER

RELATED APPLICATIONS

This application claims priority to Taiwan Application Serial Number 100116423, filed on May 11, 2011, which is herein incorporated by reference.

BACKGROUND

1. Technical Field

The present disclosure relates to a transformer.

2. Description of Related Art

As technologies advance, the types of household electrical appliances become more and more, but each electrical appliance requires different voltage and power. So, various kinds of transformers that provide different voltages and powers are needed. Currently, the industries often use two kinds of transformers. A kind of the transformers is high-frequency transformer, which generally is a switching mode power supply transformer. Another kind of the transformers is low-frequency transformer, which is a common silicon steel transformer.

A known transformer includes a bobbin and an iron core assembly. The bobbin of the transformer can be wired by the primary winding coils and the secondary winding coils. The iron core assembly is partially accommodated in the bobbin, thus the electromagnetic induction coupling generated among the iron core assembly and the primary winding coils and the secondary winding coils that wire the bobbin can achieve the purpose of voltage conversion.

However, for the known transformer, its bobbin will produce model errors in the manufacturing process, which led to a larger fitting clearance in follow-up assembly processes. This phenomenon is not conducive for production controlling of factories, and the crooked situation generated in assembly processes is not conducive for mass production. Furthermore, because the model errors of the bobbin and the assembly differences of manpower cannot be the same, not only the assembled iron core assemblies have crooked appearances, but also the gaps in the iron core assemblies cannot be the same, which makes the data of inductances of transformers distributed.

SUMMARY

In order to solve the problems of prior arts, a transformer according to an embodiment of the disclosure is provided. Sleeves can be disposed between the iron core assembly and the isolation cover and/or between the iron core assembly and the bobbin, so as to decrease the model errors and the assembly differences of manpower. Not only the sleeves can solve the problem of bad electrical characteristics caused by crooked iron core assembly, the thickness of the split boards in the sleeves can also control the gap in the iron core assembly, so as to maintain constant inductances and stable electrical characteristics. Besides, the transformer of the disclosure can omit the dispensing process by adding the engagement structures between the bobbin and the isolation cover and thus massively increase the speed and convenience of assembling and production.

According to an embodiment of the disclosure, the transformer includes a bobbin, an iron core assembly, and a first sleeve. The bobbin includes a main body and a channel passing through the main body. The iron core assembly is accommodated in the channel and surrounds the periphery of the bobbin. The iron core assembly includes a first iron core and a second iron core. The first iron core includes a first end. The first end is disposed at the periphery of the bobbin. The second iron core includes a second end. The second end is disposed at the periphery of the bobbin. A first gap is formed between the first end and the second end. The first sleeve is disposed at the first gap, so as to make the first end and the second end to be accommodated within the first sleeve. The first end is aligned opposite to the second end.

According to another embodiment of the disclosure, the transformer includes a bobbin, an iron core assembly, and an isolation cover. The bobbin includes a main body, a channel passing through the main body, and a winding portion disposed around the main body. The iron core assembly is accommodated in the channel and surrounds the periphery of the bobbin. The iron core assembly includes a first iron core and a second iron core. The first iron core includes a first end. The first end is disposed at the periphery of the bobbin. The second iron core includes a second end. The second end is disposed at the periphery of the bobbin. Wherein, the first end is aligned opposite to the second end across a first gap between the first end and the second end. The isolation cover is disposed between the winding portion and the iron core assembly. The isolation cover further includes a retaining wall located at the first gap.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
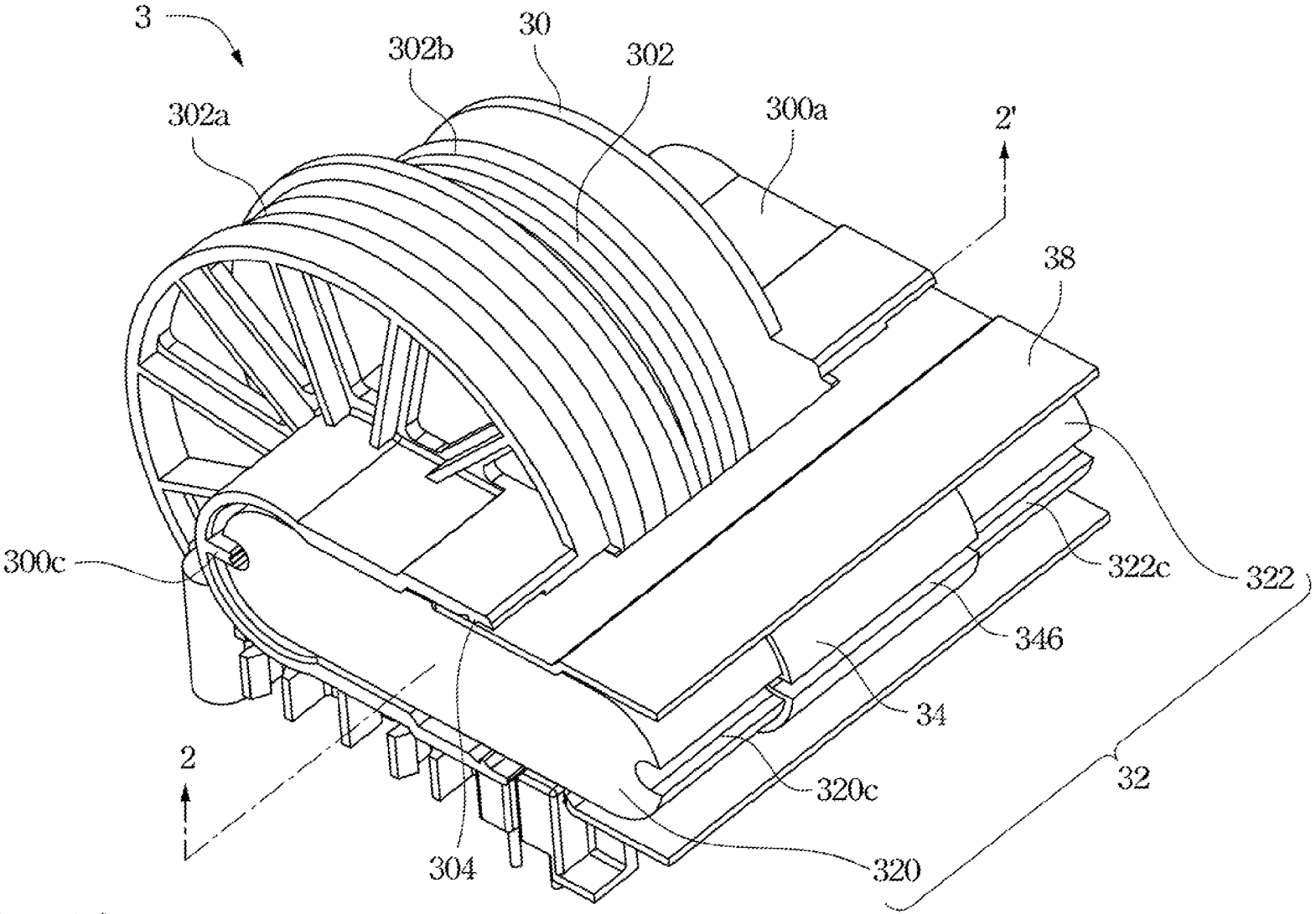
FIG. 1A is a stereoscopic view showing a transformer according to first embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

A transformer according to an embodiment of the disclosure is provided. Specifically, sleeves can be disposed between the iron core assembly and the isolation cover and/or between the iron core assembly and the bobbin, so as to decrease the model errors and the assembly differences of manpower. Not only the sleeves can solve the problem of bad electrical characteristics caused by crooked iron core assembly, the thickness of the split boards in the sleeves can also control the gap in the iron core assembly, so as to maintain constant inductances and stable electrical characteristics. Besides, the transformer of the disclosure can omit the dispensing process by adding the engagement structures between the bobbin and the isolation cover and thus massively increase the speed and convenience of assembling and production.

Figure 1B:
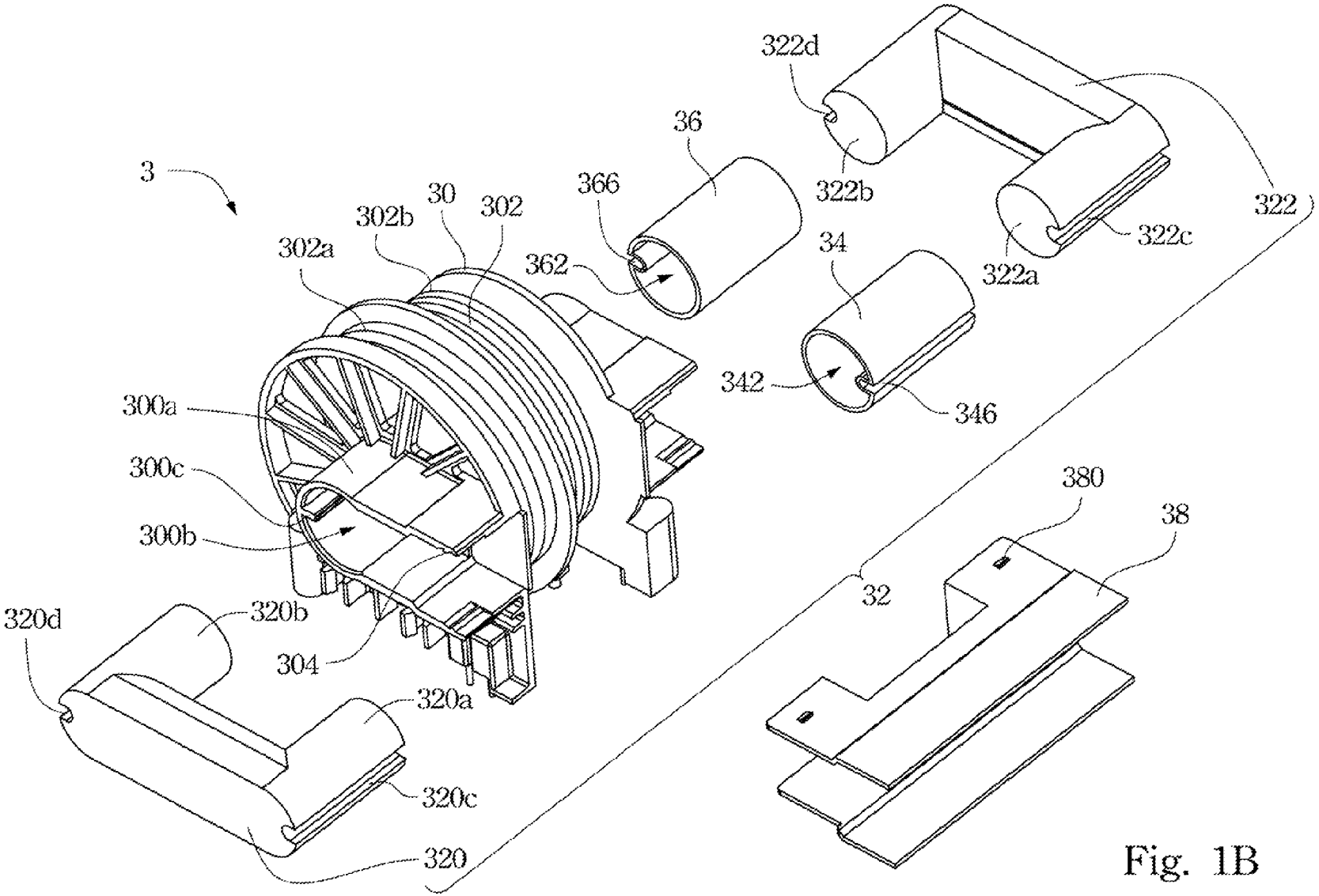
FIG. 1B is an exploded view showing the transformer in FIG. 1A.
Figure 2:
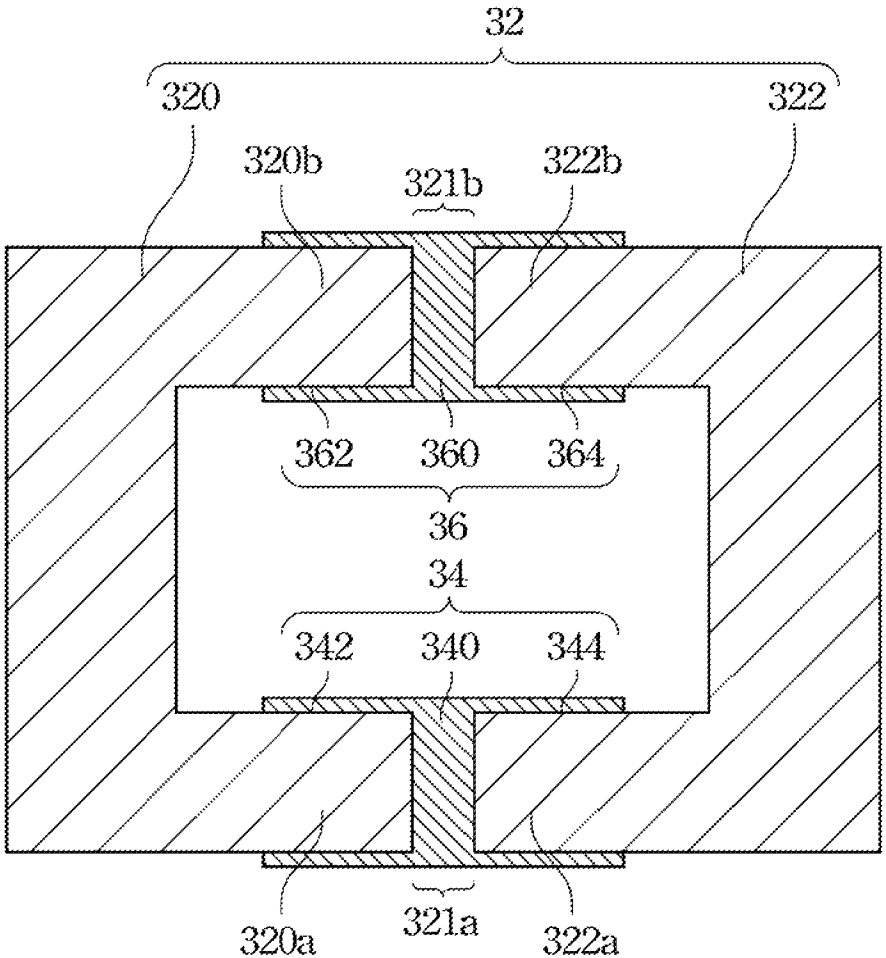
FIG. 2 is a sectional view showing the first iron core, the second iron core, the first sleeve, and the second sleeve along line 2-2' in FIG. 1A.

Please refer to FIG. 1A, FIG. 1B, and FIG. 2. FIG. 1A is a stereoscopic view showing a transformer 3 according to first embodiment of the disclosure. FIG. 1B is an exploded view showing the transformer 3 in FIG. 1A. FIG. 2 is a sectional view showing the first iron core 320, the second iron core 322, the first sleeve 34, and the second sleeve 36 along line 2-2' in FIG. 1A;

As shown in FIG. 1A and FIG. 1B, the transformer 3 of the disclosure can be, but not limited to, a DC transformer applied in a microwave oven. In other words, the transformer 3 of the disclosure can be applied in any electronic device having the requirement of voltage transformation, so as to increase the speed and convenience of assembling for that device.

As shown in FIG. 1A and FIG. 1B, the transformer 3 of the embodiment mainly includes a bobbin 30, an iron core assembly 32, a first sleeve 34, a second sleeve 36, and an isolation cover 38. The structures of all components included in the transformer 3 of the embodiment will be introduced in detail as following.

As shown in FIG. 1A and FIG. 1B, the bobbin 30 of the transformer 3 in the embodiment includes a main body 300*a*, a channel 300*b* that passes through the main body 300*a*, and a winding portion 302. The winding portion 302 of the bobbin 30 can be wired by the primary winding coils 302*a* and the secondary winding coils 302*b*. The winding portion 302 of the bobbin 30 is disposed around the main body 300*a*. The isolation cover 38 is disposed between the winding portion 302 and the first sleeve 34. The iron core assembly 32 of the transformer 3 is partially accommodated in the channel 300*b* of the bobbin 30 and partially surrounds the periphery of the bobbin 30. Thus, the electromagnetic induction coupling generated among the iron core assembly 32, the primary winding coils 302*a* and the secondary winding coils 302*b* that wire around the winding portion 302 can achieve the purpose of voltage conversion.

In the transformer 3 of the embodiment, the iron core assembly 32 can further include a first iron core 320 and a second iron core 322. The first iron core 320 can include a first end 320*a* and a third end 320*b*. The first end 320*a* of the first iron core 320 is disposed at the periphery of the bobbin 30. The third end 320*b* of the first iron core 320 is accommodated within the channel 300*b* of the bobbin 30. The second iron core 322 can include a second end 322*a* and a fourth end 322*b*. The second end 322*a* of the second iron core 322 is disposed at the periphery of the bobbin 30. The fourth end 322*b* of the second iron core 322 is accommodated within the channel 300*b* of the bobbin 30. Wherein, a first gap 321*a* is formed between the first end 320*a* of the first iron core 320 and the second end 322*a* of the second iron core 322 (as shown in FIG. 2). The first sleeve 34 is disposed at the first gap 321*a*. In other words, the first end 320*a* and the second end 322*a* are accommodated within the first sleeve 34 (i.e. the first sleeve 34 is sleeved between the first end 320*a* of the first iron core 320 and the second end 322*a* of the second iron core 322) to make the first end 320*a* of the first iron core 320 to be aligned opposite to the second end 322*a* of the second iron core 322, so as to prevent the crooked situation between the first end 320*a* of the first iron core 320 and the second end 322*a* of the second iron core 322 and the bad inductance caused by the crooked situation.

As shown in FIG. 2 and also referring to FIG. 1A and FIG. 1B, a second gap 321*b* is formed between the third end 320*b* of the first iron core 320 and the fourth end 322*b* of the second iron core 322. The second sleeve 36 is disposed at the second gap 321*b*. In other words, the third end 320*b* and the fourth end 322*b* are accommodated within the second sleeve 36 (i.e. the second sleeve 36 is sleeved between the third end 320*b* of the first iron core 320 and the fourth end 322*b* of the second iron core 322) to make the third end 320*b* of the first iron core 320 to be aligned opposite to the fourth end 322*b* of the second iron core 322, so as to prevent the crooked situation between the third end 320*b* of the first iron core 320 and the fourth end 322*b* of the second iron core 322 and the bad inductance caused by the crooked situation.

As shown in FIG. 2, the first sleeve 34 in the transformer 3 of the embodiment can further include a split board 340. The split board 340 of the first sleeve 34 separates the first sleeve 34 into a first accommodating fillister 342 and a second accommodating fillister 344. Thus, the first end 320*a* of the first iron core 320 can be accommodated within the first accommodating fillister 342 of the first sleeve 34 and abut against the split board 340. Similarly, the second end 322*a* of the second iron core 322 can be accommodated within the second accommodating fillister 344 of the first sleeve 34 and abut against the split board 340.

In order to make the first end 320*a* of the first iron core 320 to be accurately aligned opposite to the second end 322*a* of the second iron core 322, the structure and shape of the first accommodating fillister 342 of the first sleeve 34 can be in accordance with the structure and shape of the first end 320*a* of the first iron core 320, and the structure and shape of the second accommodating fillister 344 of the first sleeve 34 can be in accordance with the structure and shape of the second end 322*a* of the second iron core 322. Moreover, because both the first end 320*a* of the first iron core 320 and the second end 322*a* of the second iron core 322 abut against the split board 340 of the first sleeve 34, the distance between the first end 320*a* of the first iron core 320 and the second end 322*a* of the second iron core 322 can be controlled by the thickness of the split board 340 of the first sleeve 34. In other words, in order to make the iron core assembly 32 to match different electrical characteristics, a desired distance between the first end 320*a* of the first iron core 320 and the second end 322*a* of the second iron core 322 can be obtained by adjusting the thickness of the split board 340 of the first sleeve 34 while manufacturing the first sleeve 34. It can be seen that the first sleeve 34 can solve the problem of bad inductance due to the crooked situation between the first end 320*a* of the first iron core 320 and the second end 322*a* of the second iron core 322, and the distance between the first end 320*a* of the first iron core 320 and the second end 322*a* of the second iron core 322 can be controlled by the thickness of the split board 340 of the first sleeve 34, so as to maintain constant inductance and stable electrical characteristics. Furthermore, different electrical characteristics can be matched by simply adjusting the position of the split board 340 of the first sleeve 34 without reproducing other molds of the bobbin 30 and the isolation cover 38, so that the costs of the transformer 3 of the disclosure will not increase.

As shown in FIG. 2, the second sleeve 36 of the transformer 3 of the embodiment can further include a split board 360. The split board 360 of the second sleeve 36 separates the second sleeve 36 into a third accommodating fillister 362 and a fourth accommodating fillister 364. Thus, the third end 320*b* of the first iron core 320 can be accommodated within the third accommodating fillister 362 of the second sleeve 36 and abut against the split board 360. Similarly, the fourth end 322*b* of the second iron core 322 can be accommodated within the fourth accommodating fillister 364 of the second sleeve 36 and abut against the split board 360.

In order to make the third end 320*b* of the first iron core 320 to be accurately aligned opposite to the fourth end 322*b* of the second iron core 322, the structure and shape of the third accommodating fillister 362 of the second sleeve 36 can be in accordance with the structure and shape of the third end 320*b* of the first iron core 320, and the structure and shape of the fourth accommodating fillister 364 of the second sleeve 36 can be in accordance with the structure and shape of the fourth end 322*b* of the second iron core 322. Moreover, because both the third end 320*b* of the first iron core 320 and the fourth end 322*b* of the second iron core 322 abut against the split board 360 of the second sleeve 36, the distance between the third end 320*b* of the first iron core 320 and the fourth end 322*b* of the second iron core 322 can be controlled by the thickness of the split board 360 of the second sleeve 36. In other words, in order to make the iron core assembly 32 to match different electrical characteristics, a desired distance between the third end 320*b* of the first iron core 320 and the fourth end 322*b* of the second iron core 322 can be obtained by adjusting the thickness of the split board 360 of the second sleeve 36 while manufacturing the second sleeve 36. It can be seen that the second sleeve 36 can solve the problem of bad inductance due to the crooked situation between the third end 320*b* of the first iron core 320 and the fourth end 322*b* of the second iron core 322, and the distance between the third end 320*b* of the first iron core 320 and the fourth end 322*b* of the second iron core 322 can be controlled by the thickness of the split board 360 of the second sleeve 36, so as to maintain constant inductance and stable electrical characteristics. Furthermore, different electrical characteristics can be matched by simply adjusting the position of the split board 360 of the second sleeve 36.

Figure 3:
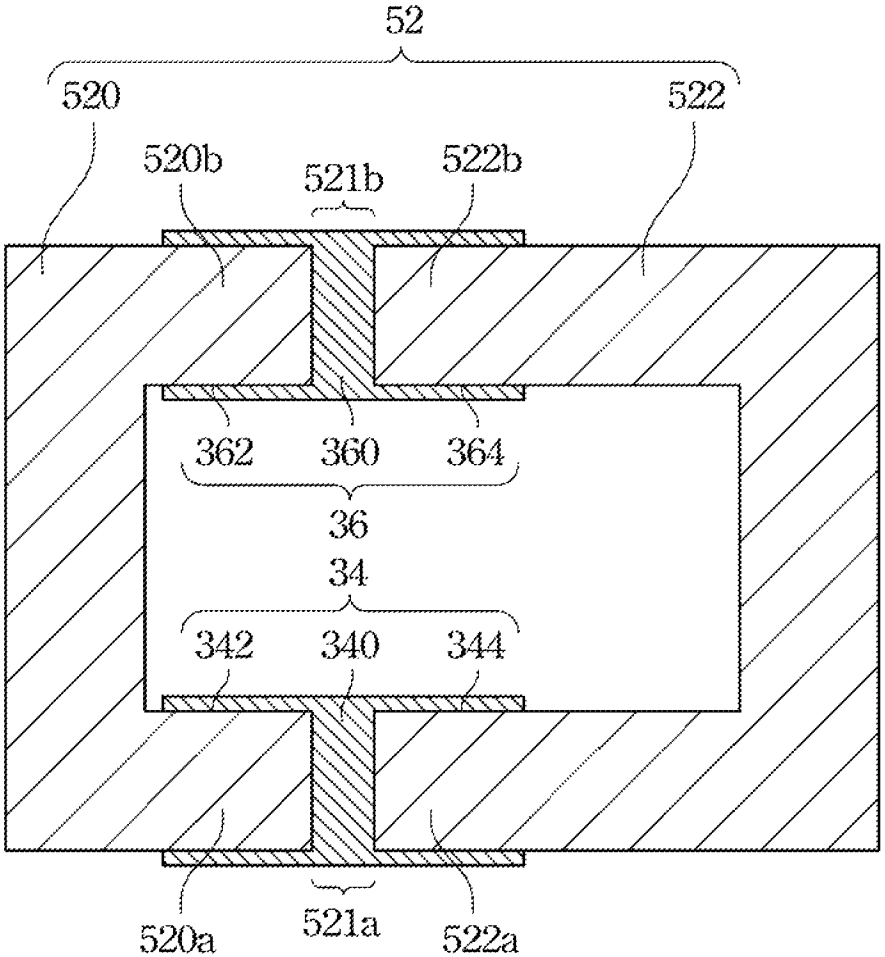
FIG. 3 is a sectional view showing the first iron core, the second iron core, the first sleeve, and the second sleeve according to second embodiment of the disclosure.

Please refer to FIG. 3. FIG. 3 is a sectional view showing the first iron core 520, the second iron core 522, the first sleeve 34, and the second sleeve 36 according to second embodiment of the disclosure.

As shown in FIG. 3, the first iron core 520 includes a first end 520*a* and a third end 520*b*, and the second iron core 522 includes a second end 522*a* and a fourth end 522*b*. The first sleeve 34 is sleeved between the first end 520*a* of the first iron core 520 and the second end 522*a* of the second iron core 522. Thus, the first end 520*a* of the first iron core 520 can be accommodated within the first accommodating fillister 342 of the first sleeve 34 and abut against the split board 340. Similarly, the second end 522*a* of the second iron core 522 can be accommodated within the second accommodating fillister 344 of the first sleeve 34 and abut against the split board 340. Besides, the second sleeve 36 is sleeved between the third end 520*b* of the first iron core 520 and the fourth end 522*b* of the second iron core 522. Thus, the third end 520*b* of the first iron core 520 can be accommodated within the third accommodating fillister 362 of the second sleeve 36 and abut against the split board 360. Similarly, the fourth end 522*b* of the second iron core 522 can be accommodated within the fourth accommodating fillister 364 of the second sleeve 36 and abut against the split board 360.

The difference between the first iron core 520 and the first iron core 320 is that the length of the first iron core 520 is different from the length of the first iron core 320, and the difference between the second iron core 522 and the second iron core 322 is that the length of the second iron core 522 is different from the length of the second iron core 322. Practically, in order to match different electrical characteristics, the first iron core 520 and the second iron core 522 that have different lengths can be adopted to change the positions of the first gap 521*a* and the second gap 521*b*. Therefore, the molds of the bobbin 30, the first sleeve 34, and the second sleeve 36 can be repeatedly used and the costs will not increase.

As shown in FIG. 1A and FIG. 1B, the first sleeve 34 can further include a guiding recessed wall 346 for guiding the first end 320*a* of the first iron core 320 and the second end 322*a* of the second iron core 322 when the first end 320*a* of the first iron core 320 and the second end 322*a* of the second iron core 322 are sleeved in the first sleeve 34. Relatively, the first end 320*a* of the first iron core 320 can include a guiding groove 320*c* corresponding to the guiding recessed wall 346 of the first sleeve 34, and the second end 322*a* of the second iron core 322 can include a guiding groove 322*c* corresponding to the guiding recessed wall 346 of the first sleeve 34. The guiding recessed wall 346 of the first sleeve 34 is slidably engaged with the guiding groove 320*c* of the first iron core 320, so the first end 320*a* of the first iron core 320 can be guided by the guiding recessed wall 346 of the first sleeve 34 while being sleeved into the first sleeve 34. Similarly, the guiding recessed wall 346 of the first sleeve 34 is slidably engaged with the guiding groove 322*c* of the second iron core 322, so the second end 322*a* of the second iron core 322 can be guided by the guiding recessed wall 346 of the first sleeve 34 while being sleeved into the first sleeve 34.

As shown in FIG. 1A and FIG. 1B, the second sleeve 36 can further include a guiding recessed wall 366 for guiding the third end 320*b* of the first iron core 320 and the fourth end 322*b* of the second iron core 322 when the third end 320*b* of the first iron core 320 and the fourth end 322*b* of the second iron core 322 are sleeved in the second sleeve 36. Relatively, the third end 320*b* of the first iron core 320 can include a guiding groove 320*d* corresponding to the guiding recessed wall 366 of the second sleeve 36, and the fourth end 322*b* of the second iron core 322 can include a guiding groove 322*d* corresponding to the guiding recessed wall 366 of the second sleeve 36. The guiding recessed wall 366 of the second sleeve 36 is slidably engaged with the guiding groove 320*d* of the first iron core 320, so the third end 320*b* of the first iron core 320 can be guided by the guiding recessed wall 366 of the second sleeve 36 while being sleeved into the second sleeve 36. Similarly, the guiding recessed wall 366 of the second sleeve 36 is slidably engaged with the guiding groove 322*d* of the second iron core 322, so the fourth end 322*b* of the second iron core 322 can be guided by the guiding recessed wall 366 of the second sleeve 36 while being sleeved into the second sleeve 36.

Besides, in order to prevent the second sleeve 36 arbitrarily rotates in the channel 300*b* of the bobbin 30 that is disadvantageous to sleeve the third end 320*b* of the first iron core 320 and the fourth end 322*b* of the second iron core 322 when the second sleeve 36 is accommodated within the channel 300*b* of the bobbin 30, the main body 300*a* of the bobbin 30 can further include a rib 300*c* corresponding to the guiding recessed wall 366 in the channel 300*b*. The structure and shape of the rib 300*c* of the bobbin 30 is slidably engaged with the guiding recessed wall 366 of the second sleeve 36, so the second sleeve 36 can be guided by the rib 300*c* of the bobbin 30 while being sleeved in the channel 300*b* of the bobbin 30.

In an embodiment, the transformer 3 of the disclosure can also omit the foregoing second sleeve 36, as long as the structure and shape of the channel 300*b* of the bobbin 30 is in accordance with the third end 320*b* of the first iron core 320 and the fourth end 322*b* of the second iron core 322, and as long as the structure and shape of the rib 300*c* of the bobbin 30 can be slidably engaged with the third end 320*b* of the first iron core 320 and the fourth end 322*b* of the second iron core 322 respectively.

As shown in FIG. 1A and FIG. 1B, in order to omit the dispensing process while mounting the bobbin 30 with the isolation cover 38 for improving assembly speed and convenience, the bobbin 30 can further include first engaging structures 304. The first engaging structures 304 are disposed at the main body 300*a* of the bobbin 30 and among two ends of the channel 300*b* and the winding portion 302, so as to be engaged with the isolation cover 38 when the isolation cover 38 is engaged to two ends of the channel 300*b*. Relatively, the isolation cover 38 can further include second engaging structures 380. The second engaging structures 380 of the isolation cover 38 and the bobbin 30 can be mounted to each other by engaging the second engaging structures 380 of the isolation cover 38 with the first engaging structures 304 of the bobbin 30 when the isolation cover 38 is engaged to two ends of the channel 300*b*. Of course, the structure and shape of the first engaging structures 304 of the bobbin 30 and that of the second engaging structures 380 of the isolation cover 38 can be exchanged (e.g., the first engaging structures 304 can be fillisters and the second engaging structures 380 can be mortises, or the first engaging structures 304 can be mortises and the second engaging structures 380 can be fillisters.), as long as the purpose of making the first engaging structures 304 of the bobbin 30 and the second engaging structures 380 of the isolation cover 38 to be mounted to each other can be achieved. Besides, the quantity of the first engaging structures 304 of the bobbin 30 is in accordance with that of the second engaging structures 380 of the isolation cover 38, and the quantity of the first engaging structures 304 and the second engaging structures 380 can be elastically adjusted according to requirements.

Figure 4:
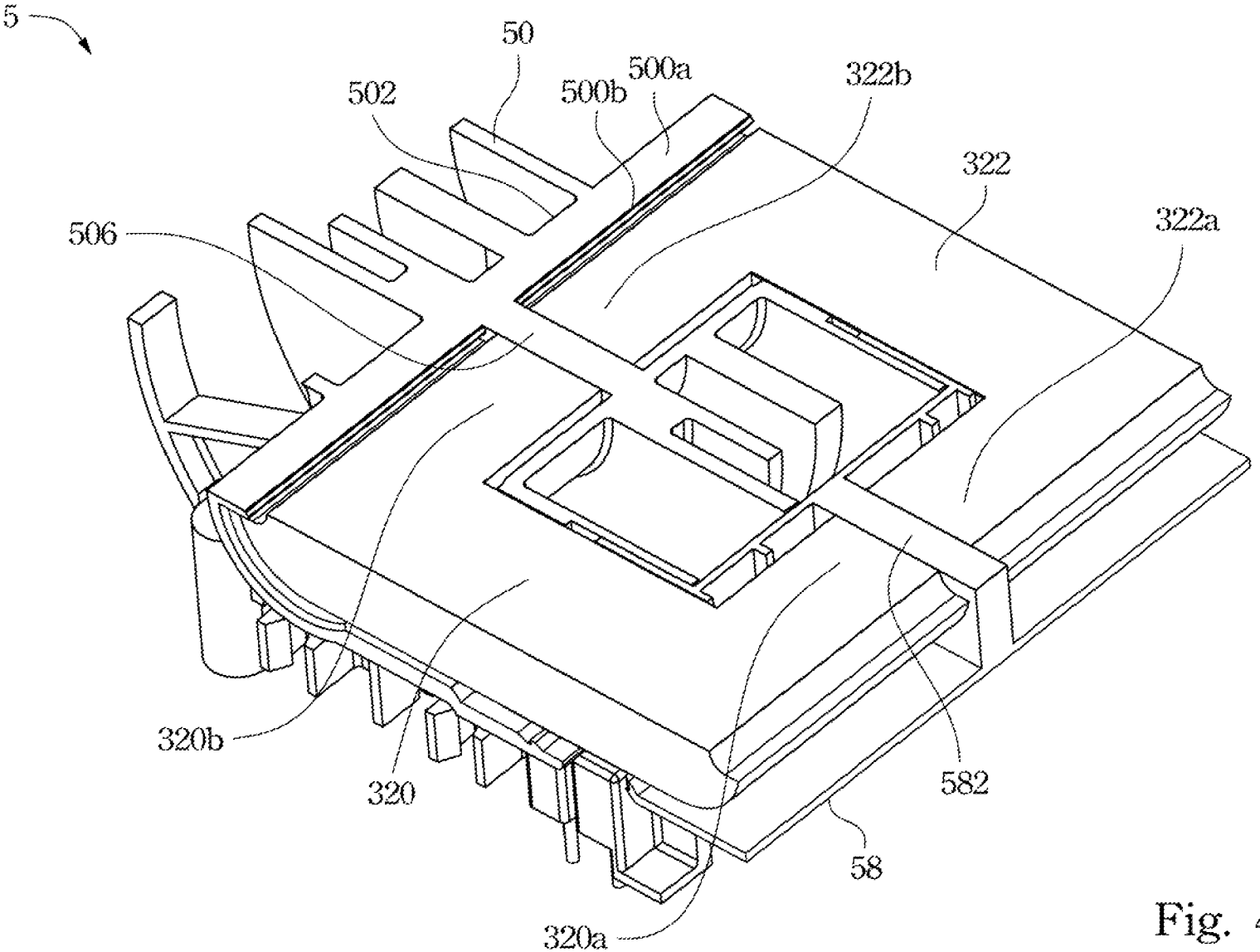
FIG. 4 is a stereoscopic and sectional view showing the transformer according to third embodiment of the disclosure.

Please refer to FIG. 4. FIG. 4 is a stereoscopic and sectional view showing the transformer 5 according to third embodiment of the disclosure.

As shown in FIG. 4, if the second sleeve 36 that sleeves the third end 320*b* of the first iron core 320 and the fourth end 322*b* of the second iron core 322 is omitted, the bobbin 50 can further include a retaining board 506 in the channel 500*b* to maintain a predetermined gap (i.e. the second gap 321*b*) between the third end 320*b* of the first iron core 320 and the fourth end 322*b* of the second iron core 322 and make the third end 320*b* of the first iron core 320 and the fourth end 322*b* of the second iron core 322 to be aligned to each other. Thus, the third end 320*b* of the first iron core 320 and the fourth end 322*b* of the second iron core 322 can be accommodated within the channel 500*b* from two ends of the channel 500*b* and abut against the retaining board 506. Similarly, if the first sleeve 34 that sleeves the first end 320*a* of the first iron core 320 and the second end 322*a* of the second iron core 322 is omitted, the isolation cover 58 can further include a retaining wall 582 to maintain a predetermined gap (i.e. the first gap 321*a*) between the first end 320*a* of the first iron core 320 and the second end 322*a* of the second iron core 322 and make the first end 320*a* of the first iron core 320 and the second end 322*a* of the second iron core 322 to be aligned to each other. The isolation cover 58 is disposed among the winding portion 502, the first iron core 320, and the second iron core 322. Thus, the first end 320*a* of the first iron core 320 and the second end 322*a* of the second iron core 322 can abut against the retaining wall 582 respectively.

According to the foregoing recitations of the embodiments of the disclosure, the transformer of the disclosure mainly includes following advantages. Sleeves can be disposed between the iron core assembly and the isolation cover and/or between the iron core assembly and the bobbin, so as to decrease the model errors and the assembly differences of manpower. Not only the sleeves can solve the problem of bad electrical characteristics caused by crooked iron core assembly, the thickness of the split boards in the sleeves can also control the gap in the iron core assembly, so as to maintain constant inductances and stable electrical characteristics. Besides, the transformer of the disclosure can omit the dispensing process by adding the engagement structures between the bobbin and the isolation cover, and thus massively increase the speed and convenience of assembling and production.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A transformer comprising:

a bobbin comprising a main body and a channel passing through the main body, and further comprising a winding portion, wherein the winding portion is disposed around the main body;

an iron core assembly, being accommodated in the channel and surrounding the periphery of the bobbin, comprising:

a first iron core comprising a first end, the first end being disposed at the periphery of the bobbin; and a second iron core comprising a second end, the second end being disposed at the periphery of the bobbin, wherein the first end is aligned opposite to the second end across a first gap between the first end and the second end;

a first sleeve being disposed at the first gap, and the first end and the second end are accommodated within the first sleeve, wherein the first sleeve further comprises a split board for separating the first sleeve into a first accommodating fillister and a second accommodating fillister, the first sleeve and the split board are integrally formed, the first end is accommodated within the first accommodating fillister and abuts against the split board the second end is accommodated within the second accommodating fillister and abuts against the split board; and an isolation cover, wherein the isolation cover is disposed between the winding portion and the first sleeve, and is located outside of the winding portion.

2. The transformer of claim 1, wherein the first sleeve further comprises a guiding recessed wall, the first end and the second end respectively comprises a guiding groove corresponding to the guiding recessed wall of the first sleeve.

3. The transformer of claim 1, wherein the bobbin further comprises at least one first engaging structure disposed at the main body, the isolation cover further comprises at least one second engaging structure, the isolation cover and the bobbin are mounted to each other by engaging the second engaging structure with the first engaging structure.

4. The transformer of claim 1, further comprising a second sleeve being accommodated within the channel, wherein the first iron core further comprises a third end, the second iron core further comprises a fourth end, the third end and the fourth end are disposed within the second sleeve in the channel, the third end is aligned opposite to the fourth end across a second gap between the third end and the fourth end.

5. The transformer of claim 4, wherein the second sleeve further comprises a split board for separating the second sleeve into a third accommodating fillister and a fourth accommodating fillister, the third end is accommodated within the third accommodating fillister and abuts against the split board, the fourth end is accommodated within the fourth accommodating fillister and abuts against the split board.

6. The transformer of claim 4, wherein the second sleeve further comprises a guiding recessed wall, the third end and the fourth end respectively comprise a guiding groove corresponding to the guiding recessed wall of the second sleeve.

7. The transformer of claim 6, wherein the main body further comprises a rib corresponding to the guiding recessed wall in the channel.

* * * * *